US007237598B2

(12) United States Patent
Zhou

(10) Patent No.: US 7,237,598 B2
(45) Date of Patent: Jul. 3, 2007

(54) REFRIGERATING DEVICE FOR A WATER STATION

(75) Inventor: Qizhan Zhou, Hangzhou (CN)

(73) Assignee: Oidi Electric Group Co., Ltd., Cixi, Zhejiang Province (CN)

( * ) Notice: Subject to any disclaimer, the term of this patent is extended or adjusted under 35 U.S.C. 154(b) by 67 days.

(21) Appl. No.: 11/024,664

(22) Filed: Dec. 30, 2004

(65) Prior Publication Data

US 2006/0080992 A1 Apr. 20, 2006

(30) Foreign Application Priority Data

Oct. 19, 2004 (CN) ..... 2004 1 0067280

(51) Int. Cl.
*B67D 5/62* (2006.01)

(52) U.S. Cl. ..... 165/63; 62/389; 222/146.1

(58) Field of Classification Search ..... 62/389–400, 62/198–200; 165/63; 222/146.1
See application file for complete search history.

(56) References Cited

U.S. PATENT DOCUMENTS 2,746,259 A * 5/1956 Katzenberger et al. ..... 62/198
4,958,747 A * 9/1990 Sheets ..... 222/67
5,495,725 A * 3/1996 Middlemiss ..... 62/389
5,553,935 A * 9/1996 Burnham et al. ..... 312/265.3
5,577,393 A * 11/1996 Donselman et al. ..... 62/390
6,101,835 A * 8/2000 Butsch et al. ..... 62/390
6,912,867 B2 * 7/2005 Busick ..... 62/338

* cited by examiner

*Primary Examiner*—William E. Tapolcai
(74) *Attorney, Agent, or Firm*—Dennison, Schultz & MacDonald

(57) ABSTRACT

A refrigerating device for a water station comprises cold storage cabinet, cold water container and refrigerating system. Said cold water container is installed in the cold storage cabinet, one end of which is connected to a water storage pail via a pipeline, and the other end is provided with a water intake pipeline. The cold water container is used for holding water that needs temperature drop. Said refrigerating system comprises compressor, condensator, capillary tubes, first evaporator and refrigerating pipelines. Said first evaporator can be installed in the cold storage cabinet or can also be installed outside the cold storage cabinet in coordination with it. Said compressor is installed under the cold storage cabinet, said refrigerating pipelines are filled with refrigerating liquid. The refrigerating device for water station of the present invention has the following advantages: the structure being simple and rational, the speed of refrigeration quick, the heat stability excellent and the utilization ratio of cold capacity high.

6 Claims, 2 Drawing Sheets

REFRIGERATING DEVICE FOR A WATER STATION

TECHNICAL FIELD

The present invention relates to a refrigerating device for a water station, in particular to a refrigerating device for water station with a cold storage cabinet refrigerated through a compressor.

DESCRIPTION OF THE PRIOR ART

At present, the components of a conventional cold and hot water station with a cold storage cabinet refrigerated by a compressor chiefly comprise compressor, cold water container, cold storage cabinet and condenser. The refrigerating device of such kind of water station is that the cold water container and the cold storage cabinet are installed in a same refrigerating system and the cold water container and the cold storage cabinet are installed separately. They both have one independent evaporator, one for the cold water container, and the other for the cold storage cabinet. These Two evaporators are used to conduct heat exchange for the refrigerated substances, so as to evaporate the heat and to achieve the aim of refrigeration.

However, this refrigerating device of the water station has the following shortcomings:

1. The ability of the refrigerating device to counteract the interference of temperature fluctuation is poor, that is, the heat stability is poor.
2. The utilization ratio of the cold capacity of the refrigerated substances does not reach the maximum.

SUMMARY OF THE INVENTION

The object of the present invention is to provide a refrigerating device for a water station, the structure of which is simple and rational, the speed of refrigeration is quick, the heat stability is excellent, and the utilization ratio of cold capacity is high.

In order to achieve the above-mentioned object, the present invention provides a refrigerating device for a water station, which comprises cold storage cabinet, cold water container and refrigerating system. Said cold water container is installed within the cold storage cabinet, one end of the container is connected to a water storage pail via a pipeline, and the other end is provided with a water intake pipeline. The cold water container is used for holding water that needs temperature drop.

Said refrigerating system comprises compressor, condenser, capillary tubes, first evaporator and refrigerating pipelines. Said first evaporator can be installed in the cold storage cabinet or can also be installed outside the cold storage cabinet in coordination with the cold storage cabinet. Said compressor is installed under the cold storage cabinet said refrigerating pipelines are pilled with refrigerating liquid.

When the compressor is started, the refrigerating liquid repeatedly makes heat exchanging cyclic motions, such as "vaporization-liquefaction vaporization--", that is, the first evaporator is to vaporize the low pressure refrigerating liquid taking the temperature at that time as room temperature, so to absorb a large amount of heat from the pipe wall and the surroundings, for example, the heat within the cold storage cabinet. An incessant cycling in this way makes the temperature in the cold storage cabinet continually lowered down, thereby the temperature of the refrigerated substance, i.e., the water placed in the cold water container and the air in the surrounding atmosphere is also continually lowered down along with it, so to achieve the aim of refrigeration.

When the cold storage cabinet is frequently opened and closed, the temperature in the cold storage cabinet will be highly raised if no cold water container is provided. However, at the present invention, since the cold water container is installed within the cold storage cabinet,the temperature of cold water rise slowly, it is equal to add another cold source. Hence, the ability of the cold storage cabinet to counteract the influence of temperature fluctuation is greatly strengthened.

The present invention provides a refrigerating device for a water station in which a mated second evaporator can also be installed outside the cold water container. This second evaporator together with the first evaporator mated with the cold storage cabinet conduct the refrigeration process through heat exchange.

The present invention provides a refrigerating device for a water station in which the cold storage cabinet can be partitioned in accordance with different requirements, so that two modes of refrigerating operations, namely quick cooling and cold storage, can be adopted.

The refrigerating device of a water station provided by the present invention has the following advantages:

1. As the cold water container is installed within the cold storage cabinet, that makes a chilling unit which is added to the cold storage cabinet, so that the speed of refrigeration in the cold storage cabinet can be greatly quickened.

Meanwhile, as the cold water container is installed within the cold storage cabinet, the cold water container is in a circumstance of comparatively lower temperature, so that the time for refrigerating the water in the cold water container is much shorter than that if the cold water container is installed outside of the cold storage cabinet, that is, the cold storage cabinet and the cold water container influence with and react on each other so to speed up the refrigeration.
2. As a chilling unit, like the cold water container, is installed within the cold storage cabinet so that the ability of the cold storage cabinet to counteract the interference of temperature fluctuation is greatly strengthened and it is easier for the cold storage cabinet to maintain the set temperature.
3. As the cold water container is installed within the cold storage cabinet, the overall refrigerating device of the water station can be designed more superiorly. That means, a larger evaporator for the cold storage cabinet can be installed in accordance with requirement, or it is also possible for the cold storage cabinet and the cold water container to have their own evaporator respectively. In this way, the counter-interference ability of the refrigerating system is comparatively stronger and the stability of temperature is better.
4. As the cold water container is installed within the cold storage cabinet, as for the layout of structure, the cold water container is remote from the hot liner of the water station; the refrigerating system and the heating system do not interfere with each other. The layout is rational; it strengthens the stability of temperature of the cold water in the cold water container and hot water in the hot liner. At the same time, it also saves energy.

DETAILED DESCRIPTION OF THE INVENTION

Figure 1:
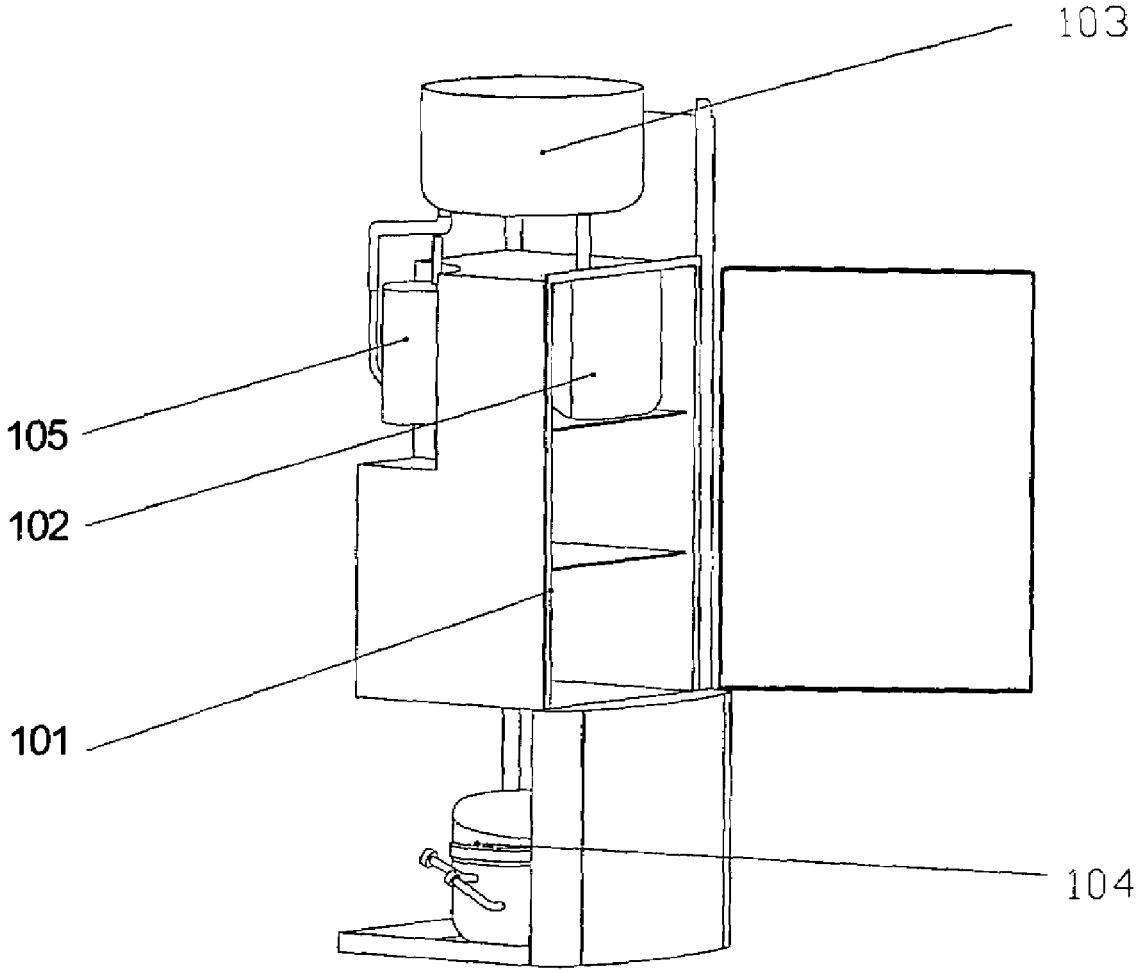
FIG. 1 is a schematic view of the structure of a refrigerating device for a water station provided by the present invention.
Figure 2:
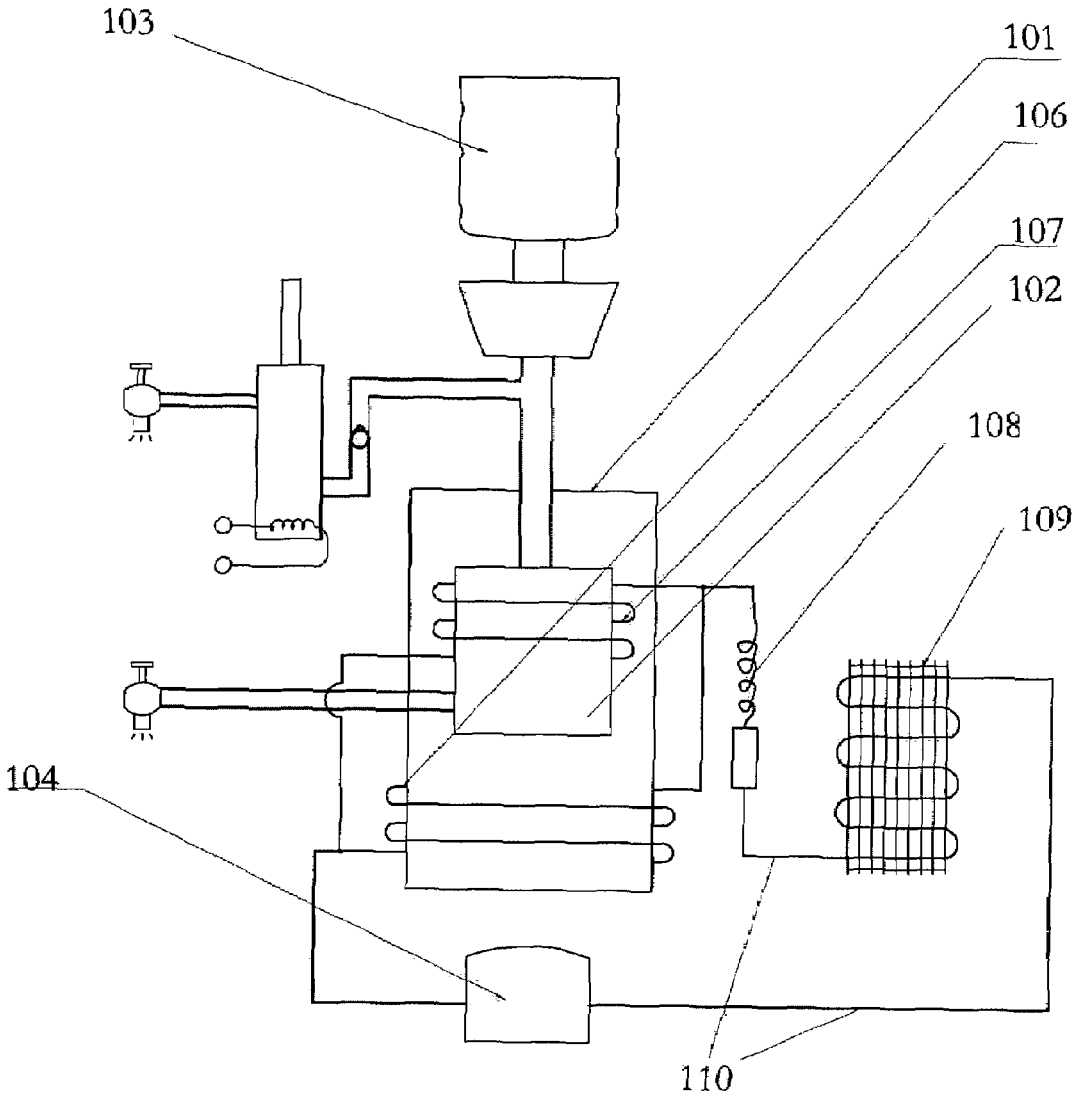
FIG. 2 is a more detailed schematic diagram of the refrigerating system according to the invention.

The following is the description of a preferred embodiment of the present invention with reference to FIGS. 1 and 2.

As shown in FIG. 1, it is a schematic view of the structure of the refrigerating device for a water station provided by the present invention, which comprises cold storage cabinet 101, cold water container 102 and refrigerating system. Said cold water container 102 is installed within the cold storage cabinet 101, one end of which is connected to a water storage pail 103 via a pipeline and the other end is provided with a water intake pipeline (not shown in the drawing) for intake of water. The water container 102 is used for holding water that needs to be refrigerated.

As shown in FIG. 2, the refrigerating system comprises compressor 104, condenser 109, capillary tubes 108, first evaporator 106 and refrigerating pipelines 110. Said first evaporator can be installed within the cold storage cabinet 101, or can also be installed, outside the cold storage cabinet 101 in coordination with the cold storage cabinet 101. Said compressor 104 is installed under the cold storage cabinet 101, said refrigerating pipelines 110 are filled with refrigerating liquid.

When the compressor 104 is started, the refrigerating liquid repeatedly makes heat exchanging cyclic motions, such as "vaporization-liquefaction-vaporization-"that is, the first evaporator 106 is to vaporize the low pressure refrigerating liquid taking the temperature at that time as room temperature, so to absorb a large amount of heat from the pipewall and the surroundings, for example, the heat within the cold storage cabinet 101. An incessant cycling in this way makes the temperature in the cold storage cabinet 101 continually lowered down, thereby the temperature of the refrigerated substance, i.e., the water placed in the cold water container 102 and the air in the surrounding atmosphere is also continually lowered down along with it, so to achieve the aim of refrigeration.

The present invention provides a refrigerating device for a water station in which a mated second evaporator 107 can also be installed outside the cold water container 102. This second evaporator 107 together with the first evaporator 106 mated with the cold storage cabinet 101 conduct the refrigeration process through heat exchange.

The present invention provides a refrigerating device for a water station in which the cold storage cabinet 101 can be partitioned in accordance with different requirements, so that in the cold storage cabinet 101 can be installed respectively a quick-cooling chamber and a cold storage chamber.

The refrigerating device of water station provided by the present invention has the following advantages:

1. As the cold water container 102 is installed within the cold storage cabinet 101 and as the refrigerating system refrigerates the cold water container 102 and, the cold storage cabinet 101 simultaneously, that makes a chilling unit which is added to the cold storage cabinet 101 so that the speed of refrigeration in the cold storage cabinet 101 is greatly quickened.

Meanwhile, as the cold water container 102 is installed within the cold storage cabinet 101, the cold water container 102 is in a circumstance of comparatively lower temperature, so that the time for refrigerating the water in the cold water container 102 is much shorter than that if the cold water container 102 alone is installed outside of the cold storage cabinet, that is, the cold storage cabinet 101 and the cold water container 102 influence with and react on each other so to speed up the speed of refrigeration.

2. As the cold storage cabinet 101 is installed within a cold water container 102, as described above, the cold storage cabinet 101 and the cold water container 102 influence with and react on each other, so that the ability of the cold storage cabinet 101 to counteract the interference of temperature fluctuation is greatly strengthened and it is easier for the cold storage cabinet 101 to maintain the set temperature.

3. As the cold water container 102 is installed within the cold storage cabinet 101, the overall refrigerating device of the water station can be designed more superiorly, that means, a larger evaporator for the cold storage cabinet 101 can be installed in accordance with requirement, or it is also possible for the cold storage cabinet 101 and the cold water container 102 to have their own evaporator respectively. On this way, the counter-interference ability of the refrigerating system is comparatively stronger and the stability of temperature is better.

4. As the cold water container 102 is installed within the cold storage cabinet 10, as for the layout of structure, the cold water container 102 is remote from the hot liner 105 of the water station, the refrigerating system and the heating system do not interfere with each other. The layout is rational, it strengthens the stability of temperature of the cold water in the cold water container 102 and hot water and in the hot liner 105. At the same time, it also saves energy.

Although the invention is described herein with reference to the preferred embodiment, one skilled in the art will readily appreciate that other applications may be substituted for those set forth herein without departing from the spirit and scope of the present invention. Accordingly, the invention should only be limited by the claims included below.

The invention claimed is:

1. A refrigerating device for a water station, comprising:

a cold storage cabinet;

a cold water container disposed within the cold storage cabinet, and including means for connection to a water supply;

a refrigerating system for refrigerating the cold storage cabinet and cold water container; and a water storage pail located externally of the cold storage cabinet and connected to the cold water container by means of a pipeline;

wherein the refrigerating system comprises a compressor located externally to and under the cold storage cabinet, a condenser, a first evaporator disposed in the cold storage cabinet, capillary tubes and refrigerating pipelines, and wherein the refrigerating system comprises means for simultaneously cooling the cold storage cabinet and cold water container to form a chilling unit in the cold storage cabinet, the refrigerating device further comprising a mated second evaporator located outside the cold storage cabinet, and a hot liner comprising a heating system external to the cold storage cabinet and remote from the cold water container of the water station, such that the refrigerating system and the heating system do not interfere with each other, whereby the cold water container is maintained at a lower temperature as compared with a cold water container located externally to the cold storage cabinet, and the cold storage cabinet and the cold water container influence and react to each other so to increase refrigerating speed, and counteract temperature fluctuation.

2. The refrigerating device for a water station as claimed in claim 1, wherein the cold storage cabinet includes a cold storage chamber and a quick-cooling chamber.

3. The refrigerating device for a water station as claimed in claim 1, wherein said refrigerating pipelines are filled with refrigerating liquid.

4. A refrigerating device for a water station, comprising:

a cold storage cabinet;

a cold water container disposed within the cold storage cabinet, and including means for connection to a water supply;

a refrigerating system for refrigerating the cold storage cabinet and cold water container; and a water storage pail located externally of the cold storage cabinet and connected to the cold water container by means of a pipeline;

wherein the refrigerating system comprises a compressor located externally to and under the cold storage cabinet, a condenser, a first evaporator disposed outside the cold storage cabinet, capillary tubes and refrigerating pipelines, and wherein the refrigerating system comprises means for simultaneously cooling the cold storage cabinet and cold water container to form a chilling unit in the cold storage cabinet, the refrigerating device further comprising a mated second evaporator located outside the cold storage cabinet, and a hot liner comprising a heating system external to the cold storage cabinet and remote from the cold water container of the water station, such that the refrigerating system and the heating system do not interfere with each other whereby the cold water container is maintained at a lower temperature as compared with a cold water container located externally to the cold storage cabinet, and the cold storage cabinet and the cold water container influence and react to each other so to increase refrigerating speed, and counteract temperature fluctuation.

5. The refrigerating device for a water station as claimed in claim 4, wherein the cold storage cabinet includes a cold storage chamber and a quick-cooling chamber.

6. The refrigerating device for a water station as claimed in claim 4, wherein said refrigerating pipelines are filled with refrigerating liquid.

* * * * *